United States Patent [19]

Theriot

[11] 4,374,505

[45] Feb. 22, 1983

[54] PORTABLE GLUE APPLICATOR

[76] Inventor: Ned B. Theriot, Rte. 3, Box 544, Baker, La. 70714

[21] Appl. No.: 257,530

[22] Filed: Apr. 27, 1981

[51] Int. Cl.[3] ..... B05C 11/00

[52] U.S. Cl. ..... 118/40; 118/41; 118/43

[58] Field of Search ..... 118/40, 41, 43

[56] References Cited

U.S. PATENT DOCUMENTS

| | | | |
|---|---|---|---|
| 1,307,542 | 6/1919 | Elder | 118/41 |
| 2,458,297 | 1/1949 | Petty | 118/43 |
| 2,839,023 | 6/1958 | Eger et al. | 118/42 |
| 2,876,730 | 3/1959 | Moore | 118/43 |
| 4,202,288 | 5/1980 | Davy | 118/41 |

*Primary Examiner*—Michael R. Lusignan
*Attorney, Agent, or Firm*—Charles C. Garvey

[57] ABSTRACT

A system of applying glue or like liquid to a continuous web comprising a frame with a reservoir. A reservoir which is capable of being sealed tightly between uses in order to stop the drying process of glue, for example: a user of the apparatus may at any given time activate the use of the glue applicator by simply removing the cover of the reservoir, placing the dispensing reel bracket and the dispensing reel into its proper lace above the reservoir. A supply reel of unsaturated material has a wound web of the material attached, which is mounted generally above the reservoir in a rotational fashion. A guide roller module is disposed within the reservoir. The rollers outer perimeter is submerged within one quarter inch from the bottom of the reservoir. This enables the tape to be submerged to the extreme bottom of the glue reservoir and gives full usage of all liquid stored within the reservoir. The guide roller module guides the dispensed web of tape material from the supply reel down into the reservoir and then upward towards the dispensing reel. The dispensing reel is removably attached to the frame of the overall apparatus and is in position for receiving the web. The dispensing reel provides a means for advancing the web from the supply reel onto the dispensing reel for subsequent dispensing.

21 Claims, 9 Drawing Figures

PORTABLE GLUE APPLICATOR

TECHNICAL FIELD

The present invention relates to the application of a liquid onto a web and more particularly relates to the application of a liquid glue product onto a web of tape material and the subsequent rewinding of that material by hand onto a removable dispensing reel so that it can be hand applied as desired once rewound onto the dispensing reel.

BACKGROUND ART

In the erection of sheet metal and fiberglass duct work, it is now being mandated by architects that all joints be sealed with a hard cast tape web and glue, which is applied while saturated and wet. It is then allowed to dry in position creating a sealed joint which is capable of standing at least 150 pounds of air pressure without leaking. This process is conserving tremendous amounts of energy throughout the United States, which would otherwise be wasted in the cooling and heating of air which is allowed to leak from unsealed joints into attics or other duct spaces.

In the preparation of various construction, such as the construction of sheet rock by placing successive joints of sheet material together, it is desirable to tape the joints between successive or consecutive panels of material using a paper-like web material which is wound on a roll and by applying glue to the web material and taping the joint and allowing the wet tape to dry in position.

The hand application of this glue and tape cited above is time-consuming and arduous and often cannot be done in a fast, easy and efficient manner.

U.S. Pat. No. 1,804,976 provides a "Ribbon Inking Device" having a pair of biased rollers and an ink reservoir for dispensing ink to a continuous ribbon.

U.S. Pat. No. 2,442,876 provides a "Method of Making Pressure Sensitive Adhesive Sheeting" using a supply reel, a reservoir of material, and a conveyor as well as a takeup reel for the coated material.

U.S. Pat. No. 1,113,872 provides a "Device for Inking and Dampening Printing Ribbons" which shows a dispensing roller immersed partially within a reservoir of ink liquid and a cooperating roller which dispenses that material to a ribbon.

U.S. Pat. No. 3,014,452 provides a "Ribbon Inking and Re-inking Device" using a supply and a takeup reel with an intermediate reel dispensing ink thereto.

U.S. Pat. 1,604,026 provides a "Method of Conditioning Paper for Coating Machines". A supply reel dispenses a web of paper material across a dispensing reel immersed in a reservoir which thereafter routes coated paper to a takeup reel.

In U.S. Pat. No. 2,661,289 an "Adhesive Transfer and Fixing Apparatus" uses a plurality of rollers to apply adhesive material to a continuous web.

DISCLOSURE OF INVENTION

None of the above-mentioned prior art devices solves the problem of applying glue or a like liquid to a continuous web in which the reservoir is capable of being sealed tightly between uses in order to stop the drying process of the glue, for example. None of the devices above-referenced solves the problem of application of tape or a web of material which is coated or saturated with a desired liquid product as glue, for example, which would be useful in the sheetmetal trade, or in the sheetrock trade.

The device would also have application to other webs of material which would be coated or saturated with a desired liquid product as, for example, doctors in repairing broken limbs using web material and plaster-of-paris.

It is an object of the present invention to provide an apparatus which allows a liquid product such as glue to be easily applied to a continuous web of material and thereafter rewound onto a hand-held dispensing reel with a crank provided on the dispensing reel allowing the operator to decide upon and wind as much material which he can thereafter use as desired.

The method of the present invention provides means for passing the supply spool web material into a reservoir and adjustably coating it with a desired predetermined amount of liquid material per lineal dimension of web length. The coated material is then wound onto a hand-held dispensing reel which is to be applied by the user as he sees fit.

It is thus an object of the present invention to provide an apparatus for the coating of a web of material such as tape by saturation or coating with a liquid material wherein the coated material is at least during storage maintained in an environment which discourages drying.

It is another object of the present invention to provide an apparatus which would be useful in the sheetmetal trade for the sealing of ducts and the like against leakage.

Another object of the present invention is to provide an apparatus which would be useful in the sheetrock trade enabling the taping of successive joints of material together as is desirable with an already coated or saturated web of tape of material.

Another object of the present invention is to provide an apparatus for coating or saturating a web of material with a desired liquid product that is compact, portable, and easily utilized by a worker in space, restricted environments.

Another object of the present invention is to provide an apparatus which is easy to use, easy to maintain, and simple in operation.

Another object of the present invention is to provide an apparatus which is useful in the coating or saturation of "hardcast tape".

It is another object of the present invention to provide an apparatus for coating or saturating a web of material with a desired liquid product wherein the interface of the web material and coating liquid can be sealed in an airtight fashion.

Another object of the present invention is to provide an apparatus which is time saving over existing manual methods of preparation of sheetmetal, duct work, and sheetrock preparation.

The above invention would be useful in the preparation of, for example, hardcast adhesive tape as manufactured by Hardcast, Inc. of Dallas, Tex. The tape is available as Hardcast No. DT-5300 and the adhesive which could be useful for the filling of the reservoir as above-described Hardcast Adhesive FTA-20.

Other types of tape or web material could be coated and/or saturated within the scope of the present invention. This would include, for example, sheetrock tape which is commercially available and could be saturated with any desirable adhesive material, glue, or the like.

BRIEF DESCRIPTION OF THE DRAWINGS

For a further understanding of the nature and objects of the present invention, reference should be had to the following detailed description, taken in conjunction with the accompanying drawings, in which like parts are given like reference numerals and wherein.

BEST MODE FOR CARRYING OUT THE INVENTION

Figure 1:
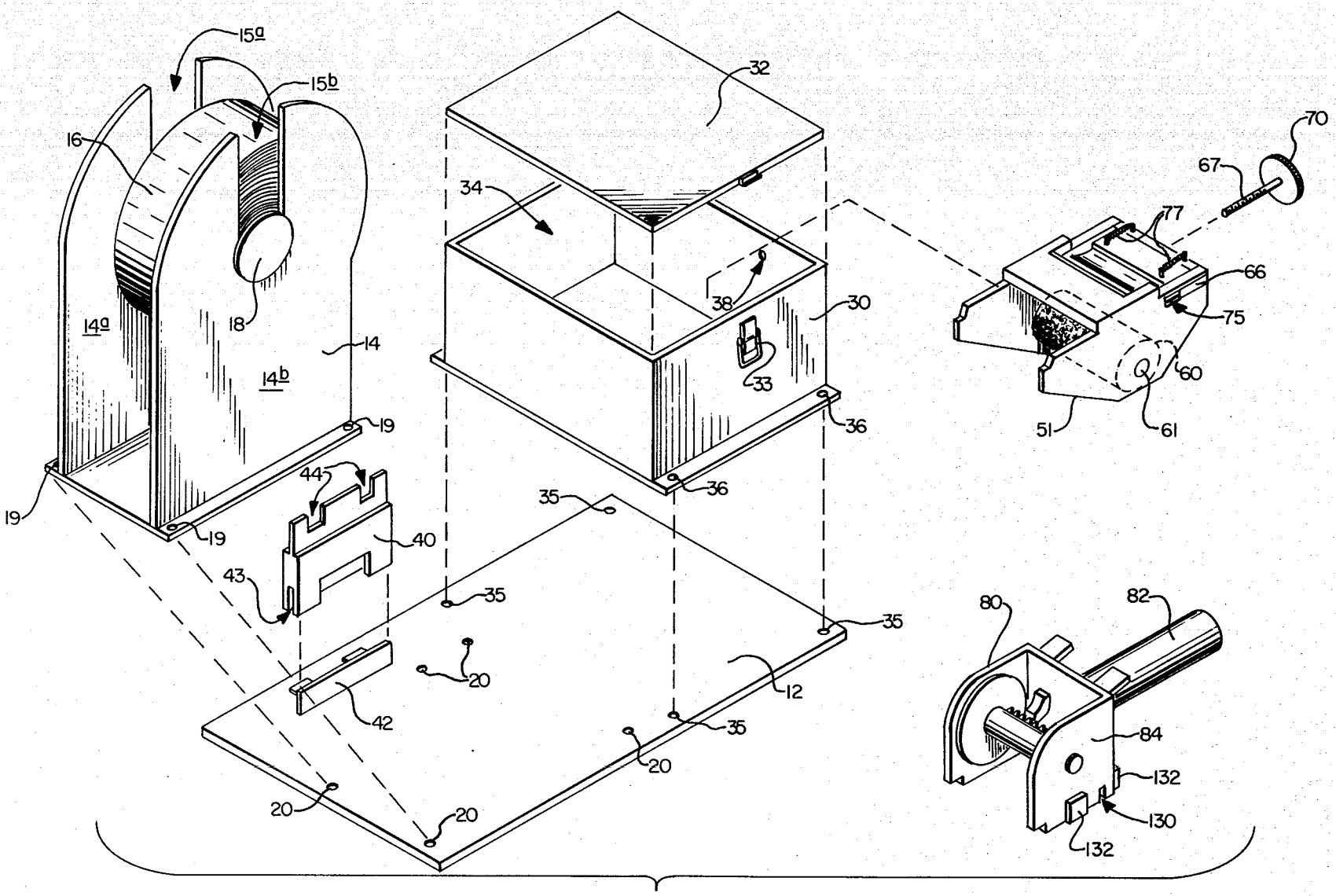
FIG. 1 is an exploded view of the preferred embodiment of the apparatus of the present invention.

FIG. 1 shows an overall view of the preferred embodiment of the apparatus of the present invention designated generally by the numeral 10. In FIG. 10 there can be seen a base plate 12 which provides a support and base for reservoir 30, supply spool stand 14, dispensing reel support bracket 40, roller module 50, and dispensing reel 80.

Figure 2:
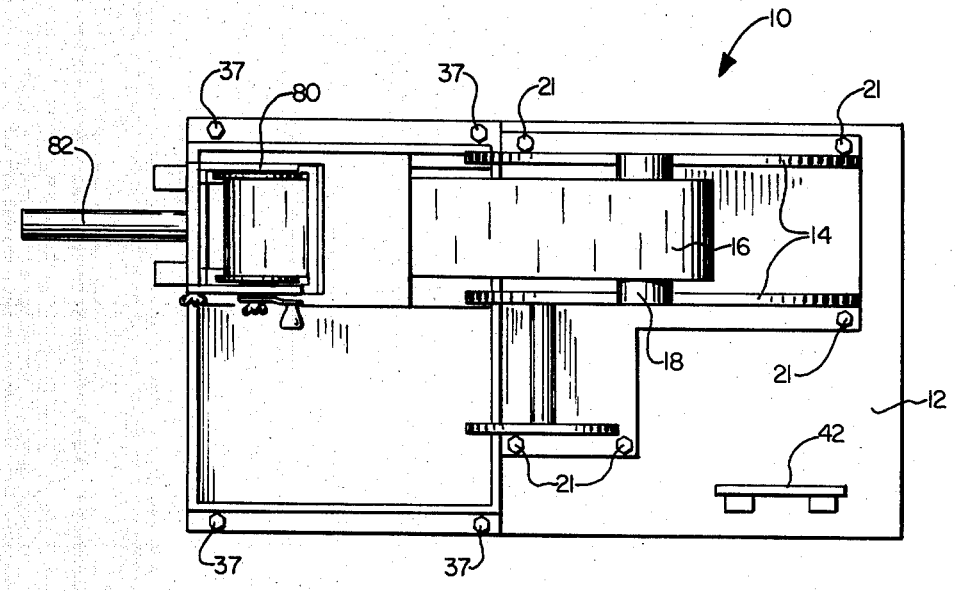
FIG. 2 is a top view thereof.
Figure 3:
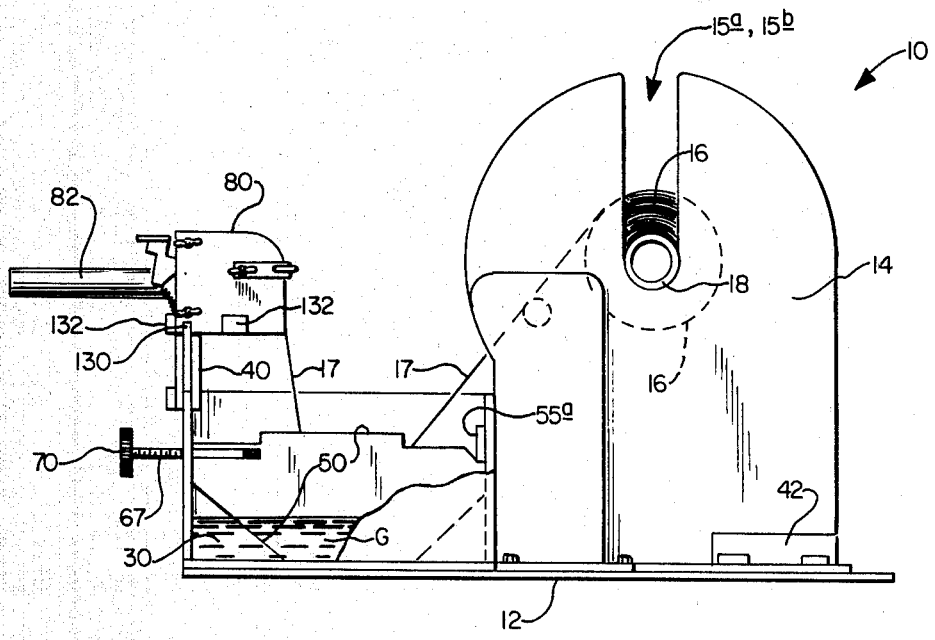
FIG. 3 is a side view thereof.
Figure 4:
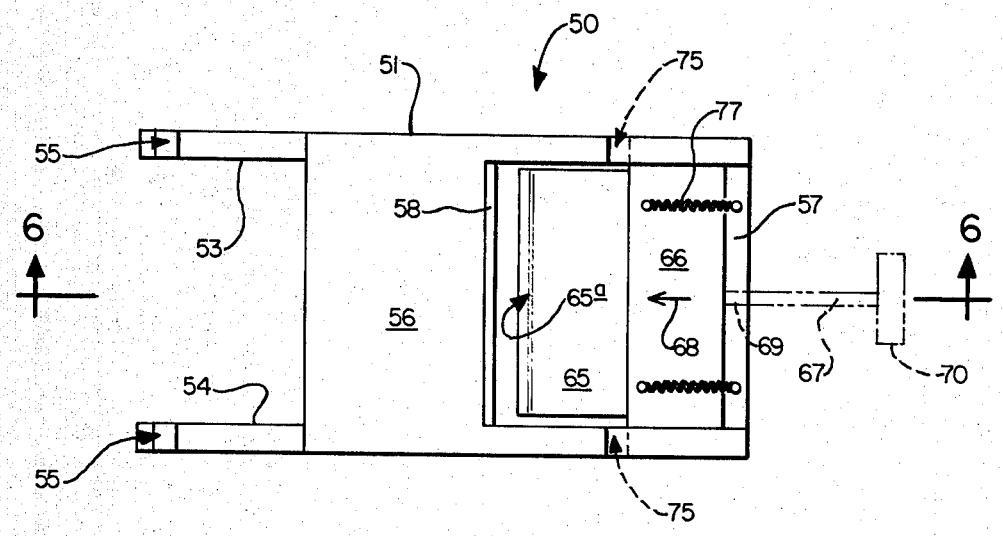
FIG. 4 is a top view of the roller module portion of the preferred embodiment of the apparatus of the present invention.
Figure 5:
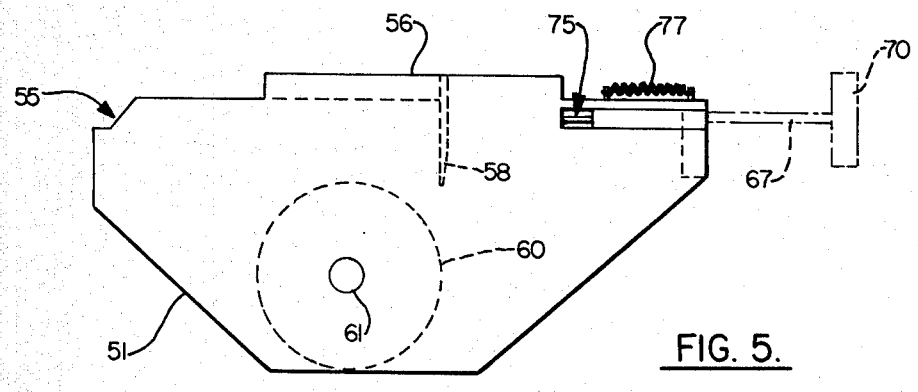
FIG. 5 is a side view thereof.
Figure 6:
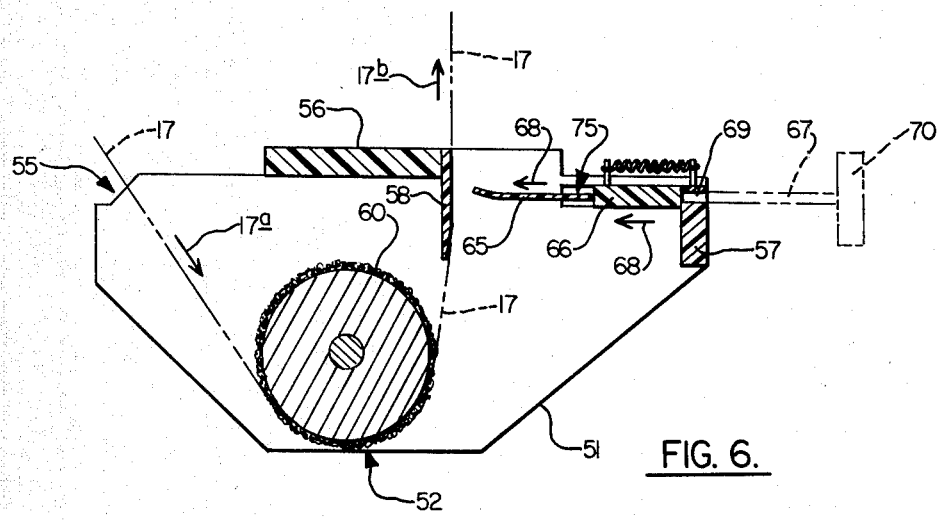
FIG. 6 is a side sectional view thereof.
Figure 7:
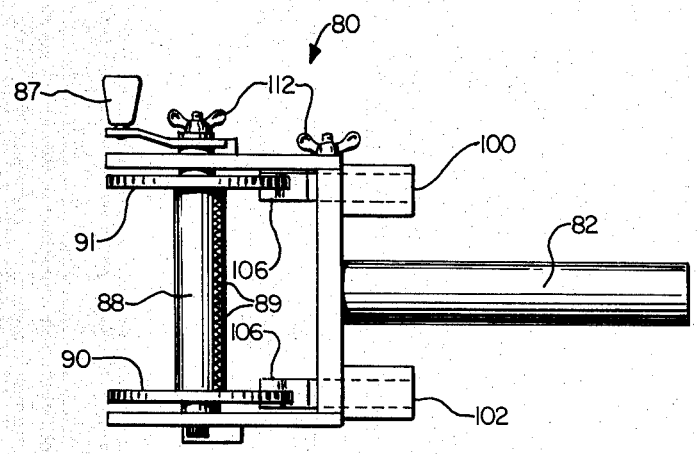
FIG. 7 is a top view of the dispensing reel portion of the preferred embodiment of the apparatus of the present invention.
Figure 8:
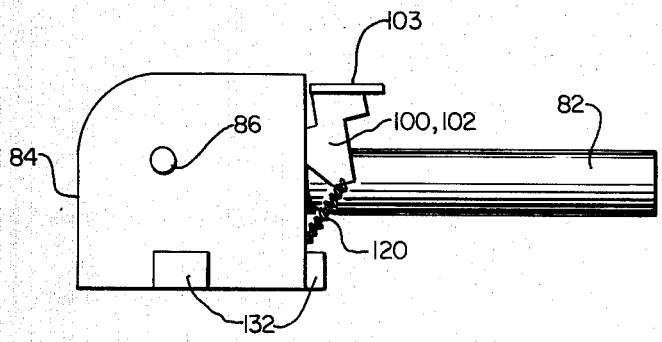
FIG. 8 is a side view thereof.
Figure 9:
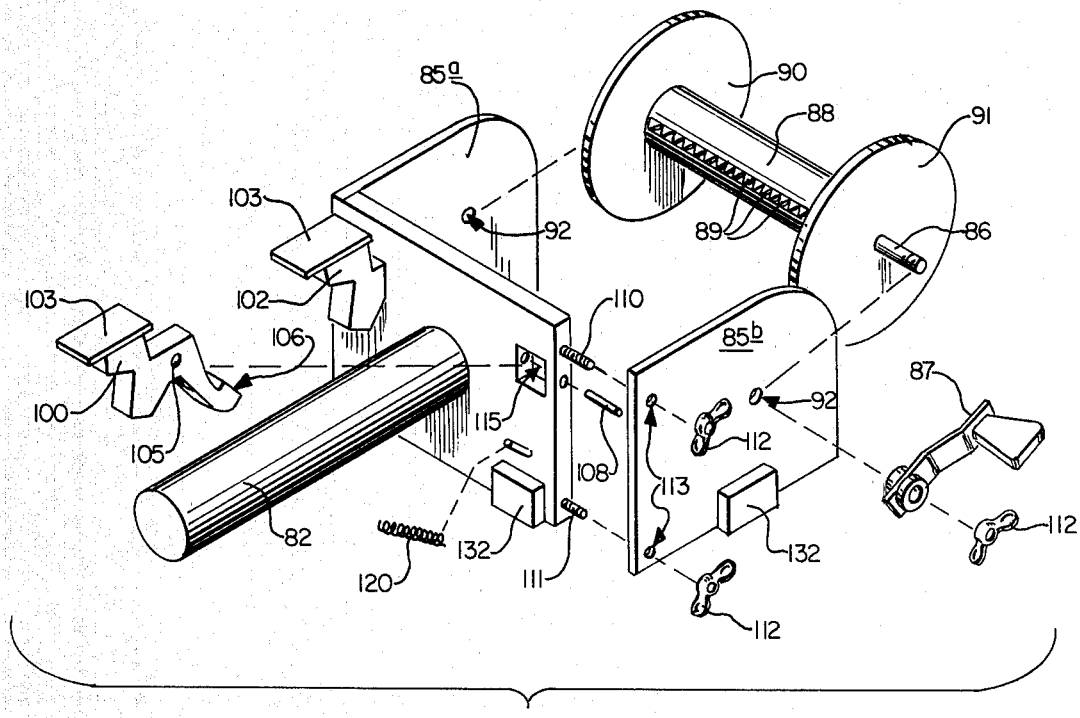
FIG. 9 is an exploded perspective view thereof.

The particular construction of roller module 50 is seen in FIGS. 4–6, while the particular construction of dispensing reel 80 is seen in FIGS. 7–9 and will be described more fully hereinafter. Top and elevational views respectively of the overall apparatus are seen in FIGS. 2 and 3.

The present invention provides an apparatus 10 which removes a supply of tape 17 from a supply spool 16, immerses that tape in a reservoir 30 of, for example, glue indicated by the letter G in FIG. 3 and thereafter retrieves the coated tape 17 onto a dispensing reel 80 where it can be removed and hand applied to, for example, joints of sheetrock or the like or any other type of application where coated tape might be useful when hand applied. A roller module 50 is placed during operation within the reservoir 30 and acts as both a guide for the tape as it travels through the reservoir 30 and the fluid contained within such as glue, G, as well as removing excess material from the tape as it exits the reservoir as will be described more fully hereinafter. The apparatus 10 of the present invention, as will be described more fully hereinafter, can be easily assembled and disassembled from a storage to an operating position.

FIG. 1 best shows the reservoir 30 portion of the apparatus of the present invention. A removable cover 32 for reservoir 30 can be attached by means of a plurality of clasps 33 with an inner space 34 being provided for housing and containerizing a product to be coated onto the web of tape 17 as it is continuously immersed within the reservoir 30. A plurality of openings 36 on reservoir 30 correspond with a plurality of openings 35 and base 12 for attachment thereto by means of bolts, screws or like fasteners 37.

A seal would be formed by using, for example, a rubber gasket or the like between the reservoir 30 and cover 32. In this manner, the liquid material which might be prone to drying out as in the case of glue, would be preserved for a good period of time as between applications of the web to product or between jobs. Note that cover 32 when attached completely encases roller module 50 in an airtight environment discouraging drying out of the liquid product such as glue or the like.

A supply spool stand 14 comprises a pair of supply spool stand halves 14A, 14B with a shaft 18 being inserted into provided recesses 15A, 15B as best seen in FIG. 1. Supply reel 16 is a roll of tape to be coated which mounts upon shaft 18 as shown in the drawings.

A plurality of openings 19 in supply spool stand 14 correspond with a plurality of openings 20 in base 12 for attachment of supply spool stand 14 to base 12 by means of fasteners such as screws or the like designated by the numeral 21 in FIG. 2.

A dispensing reel support bracket 40 attaches to base 12 in a removable fashion by means of magnets, for example, and provides an underside groove 43 which cooperates with a provided stand 42 on base 12. It is desirable that dispensing reel support bracket 40 be removable from its position on stand 42 to a position on the edge of reservoir 30 which is seated in underside groove 43 as shown in FIG. 3. In that position, as will be described more fully hereinafter, hand held dispensing reel 80 rests upon dispensing reel support bracket 40 at notches 44 which cooperate with notches 130 provided on the dispensing reel 80 itself.

FIGS. 4–6 show particularly the construction of roller module 50. Roller module 50 provides guides 55 for the web of tape 17 as it passes into reservoir 30 and is immersed in the liquid or the like which is contained therein. The roller module 50 is attached to the inner space 34 of reservoir 30 by means of an interlocking engagement between retainer bar 55A mounted within reservoir 30 and guides 55 of roller module 50 as seen in FIG. 3. Attachment of roller module 50 to reservoir 30 is also by means of threaded push rod 67 which passes through opening 38 of reservoir 30 as best seen in FIG. 3.

Roller module 50 provides a module frame 51 having top 56 and bottom 52 which normally abuts against the bottom of reservoir 30. Sides 53, 54 are beveled allowing liquid to get to the central portion of frame 51 adjacent roller 60. Roller 60 is mounted upon shaft 61 and during operation acts as a guide for the web of tape 17 as it moves into reservoir 30 as shown by arrows 17A in FIG. 6 as it moves toward guide 58 and departs reservoir 30 as shown by arrows 17B in FIG. 6. A doctor blade or a "squeeze-gee" 165 provides a means for adjustably removing excess liquid from tape 17 as it exits in the direction of arrows 17B in FIG. 6.

An adjustability to blade 65 is seen by providing a threaded push rod 67 which is threadably engaged into the threaded opening 69 at the front 57 of module frame 51. By rotation of knob 70, rod 67 moves inwardly and outwardly depending on the direction of rotation of knob 70 to urge a push bar 66 inwardly in the direction of arrow 68 or outwardly depending upon the direction of rotation. Push bar 66 is mounted integrally with blade 65 and rides at its edge portion in grooves 75 provided on each side 53, 54 of frame 51. Springs 77 are attached to the top of bar 66 at one end of the coil and to front 57 at the other end of the coil for providing the force to move bar 66 outwardly opposite arrow 68, once rod 67 is withdrawn from contact with bar 66.

FIGS. 7–9 illustrate more particularly the construction of dispensing reel 80. Reel 80 provides a frame 84 to which is attached a handle 82 for hand grasping the entire reel assembly. A shaft 86 is connected at one end portion to crank 87 and provides an inner roller 88 which has serrations 89 thereupon to enhance gripping of tape 17 and to cut a desired length tape from the web. Side guides 90, 91 retain the tape 17 in a uniform fashion upon roller 88 and also provide surfaces at their edges upon which brakes 100, 102 can bear (as when engaged) in order to impart friction thereto. Each brake 100, 102 provides a key 103 for actuation by the thumb, for example, of the operator and each brake mounts through opening 115 in frame 84 by means of pin 108 with a bearing surface 106 projecting inwardly as seen in FIG. 7. Thumb depression upon key 103 presses bearing surface 106 upwardly to engage either guide 90 or 91 as shown in FIG. 7. This apparatus allows the brake to be applied by either a left-handed or right-handed individual. Springs 120 can be supplied for retaining the brake mechanism in a non-bearing or bearing posture as desired. Magnets 132 are supplied for securing dispensing reel 80 to the frame in its portable configuration.

Disassembly of dispensing reel 80 is seen by providing openings 113 in frame side 85B with threaded studs 110, 111 passing therethrough with assembly being completed by wing nuts 112, for example. The opposite end portions of each stud 110, 111 would be embedded within frame 84.

A wing nut 112, for example, could be used to assemble crank 87 to shaft 86.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A device for applying liquid to a continuous web of material comprising:

a. a frame;

b. a supply spool having a wound web of material thereon and mounted during operation on said frame;

c. a reservoir at least partially filled during operation with a liquid to be applied to said material and supported adjacent said spool by said frame;

d. a removable guide roller means disposed within said reservoir during operation for supporting guiding a portion of said web of material guided into said reservoir for coating, said roller means being a removable assembly comprising at least a roller support frame, and a roller rotatably movable thereon; and e. guided dispensing reel means removably attachable to said web after said web is coated, for advancing said web from said supply reel to said reservoir for coating and thence onto said dispensing reel means.

2. The apparatus of claim 1 wherein said dispensing reel means is a reel having a handle thereon for hand holding said dispensing reel.

3. The apparatus of claim 1 wherein said guide roller means includes at least one rotatable roller positioned at least partially below the level of liquid within said reservoir so that rotation of the roller stirs the liquid in the reservoir.

4. The apparatus of claim 1 wherein said dispensing reel includes a means for cutting said web of material at a desired length.

5. The apparatus of claim 1 wherein said guide roller means includes a frame and a roller mounted rotatably thereon and disposed within said reservoir and having a rotational axis generally parallel to the rotational axis of said supply spool.

6. The apparatus of claim 1 further comprising means carried on said roller support frame adjacent said guide roller means for regulating the amount of liquid applied to said web as it passes through said reservoir.

7. The apparatus of claim 1 wherein said guide roller means is removable from said reservoir and said reservoir provides a removable lid which can be sealed substantially airtight thereon.

8. The apparatus of claim 1 further comprising attachment means on said frame for attaching said dispensing reel means on said frame in a position removed from the interior of said reservoir.

9. The apparatus of claim 8 wherein said dispensing reel means includes a roller having a rotational axis generally parallel to the rotational axis of said supply spool and guide roller means when said dispensing means is attached to said frame.

10. The apparatus of claim 1 wherein said supply spool has a wound web of tape.

11. The apparatus of claim 1 wherein said frame, supply spool, reservoir, guide roller and dispensing means are constructed of a plastic.

12. The apparatus of claim 1 wherein said guide roller means includes a means for removing excess liquid from the said material as it exits said reservoir.

13. A portable device for applying liquid to a continuous web of material comprising:

a. a frame;

b. a supply spool having a wound web of material thereon and mounted during operation on said frame;

c. a reservoir filled during operation with a liquid to be applied to said material and a removable lid for sealing the reservoir interior;

d. a removable guide roller assembly means removably within said reservoir interior during operation for guiding a portion of said web of material into said reservoir for coating;

e. a means carried adjacent to by said guide roller means for regulating the amount of liquid applied to said web as it passes through said reservoir; and f. dispensing reel means removably attached to said frame and removably attachable to said web after said web is coated, for advancing said web from said supply reel to said reservoir for coating and thence onto said dispensing reel means.

14. The apparatus of claim 13 wherein said dispensing reel means is a reel having a handle thereon for hand holding said dispensing reel.

15. The apparatus of claim 13 wherein said reservoir is filled with glue.

16. The apparatus of claim 13 wherein said supply spool has a wound web of tape.

17. The apparatus of claim 13 wherein said guide roller means includes at least one roller positioned at least partially below the level of liquid within the reservoir.

18. The apparatus of claim 13 wherein said guide roller includes a roller disposed within said reservoir and having a rotational axis generally parallel to the rotational axis of said supply spool.

19. The apparatus of claim 18 wherein said dispensing reel means includes a roller having a rotational axis generally parallel to the rotational axis of said supply spool and guide roller means when said dispensing means is attached to said frame.

20. The apparatus of claim 13 wherein said guide roller means includes a means for removing excess liquid from said material as it exits said reservoir.

21. The apparatus of claim 14 wherein said dispensing reel includes a means for cutting said web of material at a desired length.

* * * * *